US006009623A

United States Patent [19]

Orloff

[11] Patent Number: 6,009,623

[45] **Date of Patent: *Jan. 4, 2000**

[54] RAZOR WITH IN SITU SENSOR

[75] Inventor: Glennis J. Orloff, Guilford, Conn.

[73] Assignee: Warner-Lambert Company, Morris Plains, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/942,527

[22] Filed: Oct. 2, 1997

[51] Int. Cl.[7] ..... B26B 21/00

[52] U.S. Cl. ..... 30/41.7; 30/41.8

[58] Field of Search ..... 30/41.7, 41.8, 30/526, 537

[56] References Cited

U.S. PATENT DOCUMENTS

| | | | |
|---|---|---|---|
| 3,631,595 | 1/1972 | Scott et al. | 30/45 |
| 3,879,844 | 4/1975 | Griffiths | 30/41.7 X |
| 4,380,121 | 4/1983 | Naimer et al. | 30/42 X |
| 5,111,580 | 5/1992 | Bosscha et al. | 30/41.7 X |
| 5,146,680 | 9/1992 | Bakhos | 30/34.2 X |
| 5,165,170 | 11/1992 | Sagol et al. | 30/34.05 X |
| 5,347,715 | 9/1994 | Friedland | 30/41.7 X |
| 5,500,635 | 3/1996 | Mott | 340/323 R |
| 5,600,888 | 2/1997 | Becker | 30/41.7 X |
| 5,671,535 | 9/1997 | Van Der Borst et al. | 30/43.6 X |
| 5,789,844 | 8/1998 | De Groot | 310/329 |

FOREIGN PATENT DOCUMENTS 5076662 3/1993 Japan .

OTHER PUBLICATIONS

Beckwith et al., Mechanical Measurements (3rd ed.), pp. 106–109 & 427–431, Nov. 1982.

*Primary Examiner*—M. Rachuba
*Attorney, Agent, or Firm*—Charles W. Almer

[57] ABSTRACT

The present invention discloses a wet shave shaving system which contains an in situ sensor within the razor cartridge or razor handle. The sensor preferably comprises either a piezoelectric or a piezoresistive material which produces an electrical signal or resistance change when it is strained. In an active feedback system, the signal would be transferred from the cartridge to the razor handle where an electronically-active actuator would extend or retract as necessary to position the cartridge to produce a shave with a constant shave force. In a passive feedback system, the signal would be transferred from the cartridge to the handle where an electronically-activated element, such as an indicator light, would be activated to produce an indication to the user that he or she should reposition the razor to produce a constant shave force. In an alternative embodiment, the passive feedback system signal would provide an indication to the user that the blades are worn and the cartridge or razor should be replaced.

21 Claims, 8 Drawing Sheets

RAZOR WITH IN SITU SENSOR

BACKGROUND OF THE INVENTION

1. Field of the Invention

This invention relates to the placement of one or more in situ sensors in razor heads, cartridges, or handles to produce a movement or indication to aid in the quality of the shave.

2. Description of Related Art

Efforts to improve shave quality have been on-going for many years. Much of the effort to improve shave quality has been directed toward making razor cartridges and blades more responsive to the various forces encountered by the razor during shaving. Examples of the results include razor systems having movable components, such as blades, cartridges which flex or bend in response to shaving forces and blades which move inward and outward in response to those forces. One common thread between all previous shaving systems with movable components is that the movements are produced by the function of a mechanical element, such as a spring or pivot. Consequently, one limitation on the function of all of these prior razor systems is that they are only as sensitive as their mechanical elements.

It would be advantageous to provide a razor system which did not depend upon mechanical elements for sensing the need for movement of the razor components but instead depended upon a more sensitive medium, such as an electronic sensor, to signal that the position of the razor cartridge or the cartridge itself needs changing. Accordingly, it is an objective of the present invention to provide a razor system having electronic sensors which provide a signal which produces movement to adjust the position of the blades or produces an indication to the user that the blades should be repositioned or replaced.

SUMMARY OF THE INVENTION

The present invention is directed to a wet shave shaving system which contains an in situ sensor within the razor cartridge. The sensor preferably comprises either a piezoelectric or a piezoresistive material which produces an electrical signal or resistance change when it is strained. In an active feedback system, the signal would be transferred from the cartridge to the razor handle where an electronically-activated actuator would extend or retract as necessary to position the blades to produce a shave with a constant shave force. In a passive feedback system, the signal would be transferred from the cartridge to the razor handle where an electronically-activated element, such as an indicator light, would be activated to produce an indication to the user that he or she should reposition the razor to produce a constant shave force. In an alternative embodiment of the passive feedback system, the signal would provide an indication to the user that the blades are worn and should be replaced.

DETAILED DESCRIPTION OF THE PREFERRED EMBODIMENTS

Reference will now be made to the presently preferred embodiments of the invention. For the purpose of this application, wet shave razors are defined to be razors which are customarily utilized in conjunction with soap or shaving cream and hot water. The definition of wet shave razors includes both disposable razors, in which the user discards the entire unit after a certain number of uses, and permanent systems, with which the user discards and replaces the razor cartridge after a certain number of uses. In both instances, the razor head, or cartridge, is the portion which surrounds and contains the blade or blades. The combination of the razor head and the handle, either permanent or disposable, is defined as the razor system.

The present invention provides for a wet shave razor head having one or more in situ sensors which receive and produce a response to the forces encountered by the razor head during shaving. The sensors are preferably constructed from either a piezoelectric or a piezoresistive material which produce an electrical signal or resistance change when they are strained. A preferred piezoelectric polymer is polyvinylidene fluoride (PVDF) of the type sold by Amp Inc., Valley Forge, Penn. PVDF is especially preferred as a sensor because it is very flexible and provides a good, strong electrical signal. In addition, PVDF is commercially available in forms of various thickness which facilitates the processing of the material into a sensor which may be placed in virtually any location in a razor system. One preferred form of the piezoelectric polymer sensor is a film which is applied directly to or close to the blades within the razor head. Preferred piezoresistive materials include graphite or pressure sensitive inks placed between mylar or another flexible, non-conductive support, conductive foams and strain gauges consisting of a grid of fine wire or a constantan metal foil grid encapsulated in a thin resin backing. These piezoresistive materials are all capable of producing an electrical signal in response to forces encountered during shaving. In an alternative embodiment, the sensor may comprise a potentiometer.

Figure 1:
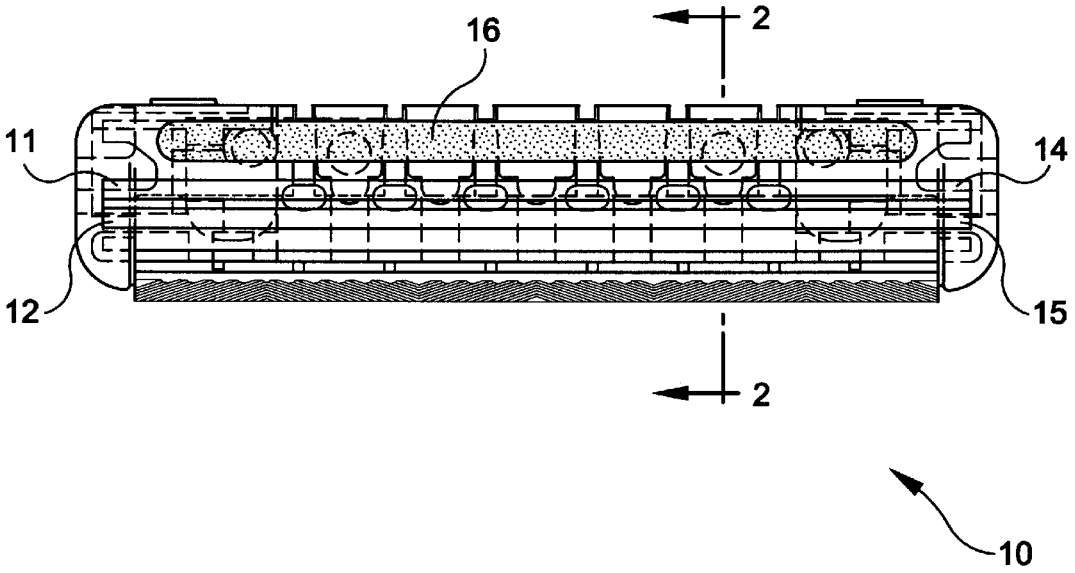
FIG. 1 is a top view of a razor cartridge having an in situ sensor.
Figure 2:
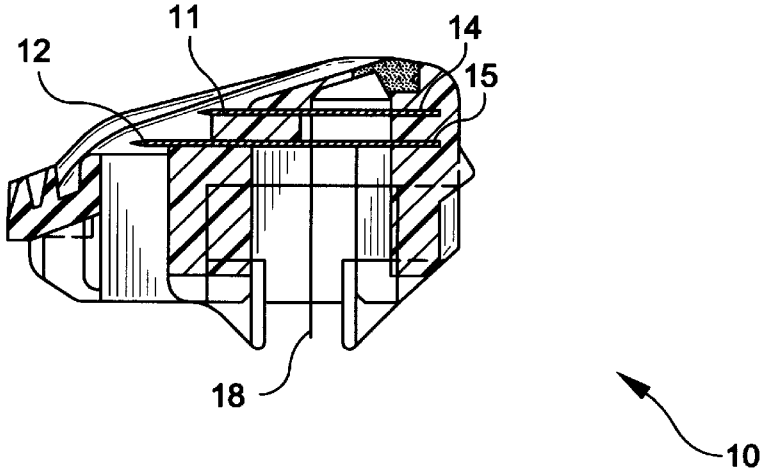
FIG. 2 is a cut-away view through line 2—2 of the razor cartridge having an in situ sensor.

The in situ sensor may be placed in any desired location on the razor and FIGS. 1–4 illustrate presently preferred sensor locations. In addition, while the figures illustrate cartridges having two blades, the in situ sensor may be utilized in a razor having one, two, three or any other number of blades. FIGS. 1 and 2 illustrate cartridge 10 having two blades, 11, 12 and, in a preferred embodiment, comfort strip 16. The in situ sensor, in the form of a piezoelectric polymer or piezoresistive film 14, 15, is coated on a portion of blades 11, 12 such that the film will be in a position to detect the result of the forces encountered during shaving and to provide an electrical signal based on those forces. Among the various forces which normally will be encountered are those which flex the cartridge upward or downward and those which produce stress and strain on the blade or blades. Means for transmitting the electrical signal from the in situ sensor to the receptor are also provided within the razor head. Preferably, such transmitting means comprise a conductive material, such as wire 18, which receives the electrical signal or signals from the sensor or sensors and then transmits the signals through the razor head to one or more receptors, which are preferably located within the razor handle.

Figure 3:
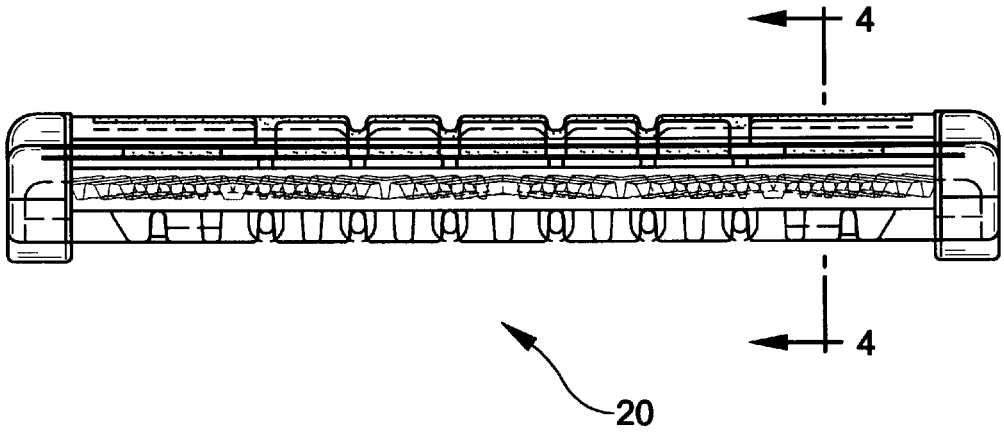
FIG. 3 is a front view of an alternative embodiment of a razor cartridge having an in situ sensor.
Figure 4:
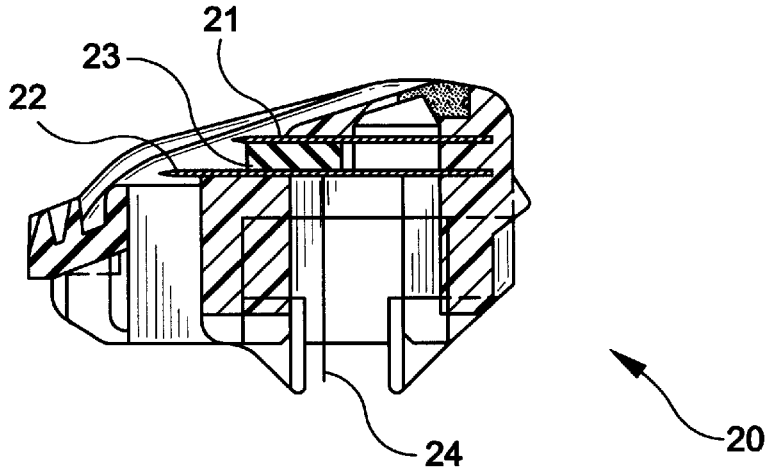
FIG. 4 is a cut-away view through line 4—4 of the razor cartridge having an in situ sensor.

An alternative in situ sensor site is illustrated in FIGS. 3 and 4. In this embodiment, the in situ sensor is in the form of a solid piece of a piezoelectric or piezoresistive material 23, preferably PVDF or a composite thereof, which is located between the two blades 21, 22. The sensor acts as a spacer to hold the two blades away from each other and at the same time detects the result of forces encountered during shaving. The location of the sensor in this embodiment is particularly useful for detecting forces acting on the razor head 20. The sensor generates an electrical signal from the forces transmitted through transmitting means 24 to one or more receptors which are preferably located within the razor handle.

Figure 5A:
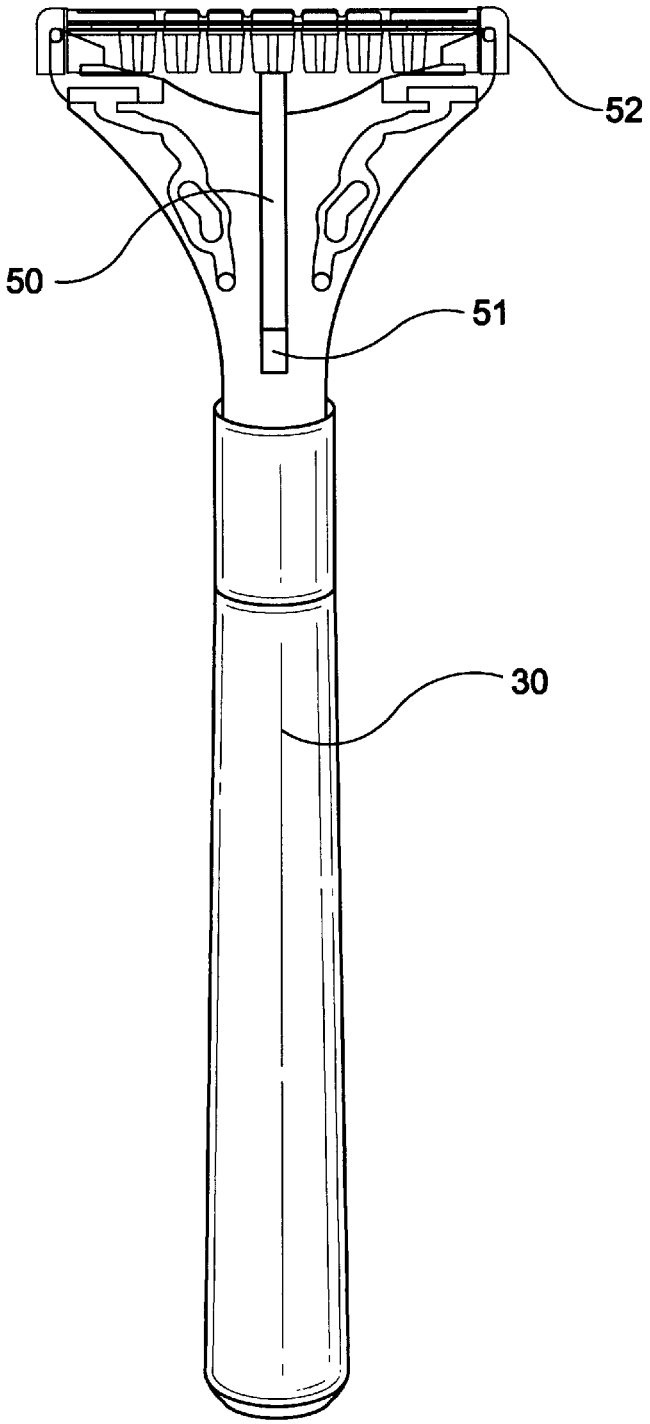
FIG. 5A is a top view of razor handle and a cut-away view of a razor cartridge having an in situ sensor in the handle.

In a further alternative embodiment, the sensor may be positioned within the razor handle. In this embodiment, the sensor would indirectly measure the forces on the blade or blades which are transferred to the handle. A preferred embodiment of this alternative illustrated in FIG. 5A employs a piezoresistive or piezoelectric sensor 51 which is placed in the handle 30. A movable piston 50 is placed in contact with the razor cartridge 52 or blades and translates the forces encountered during shaving to the sensor.

Figure 5B:
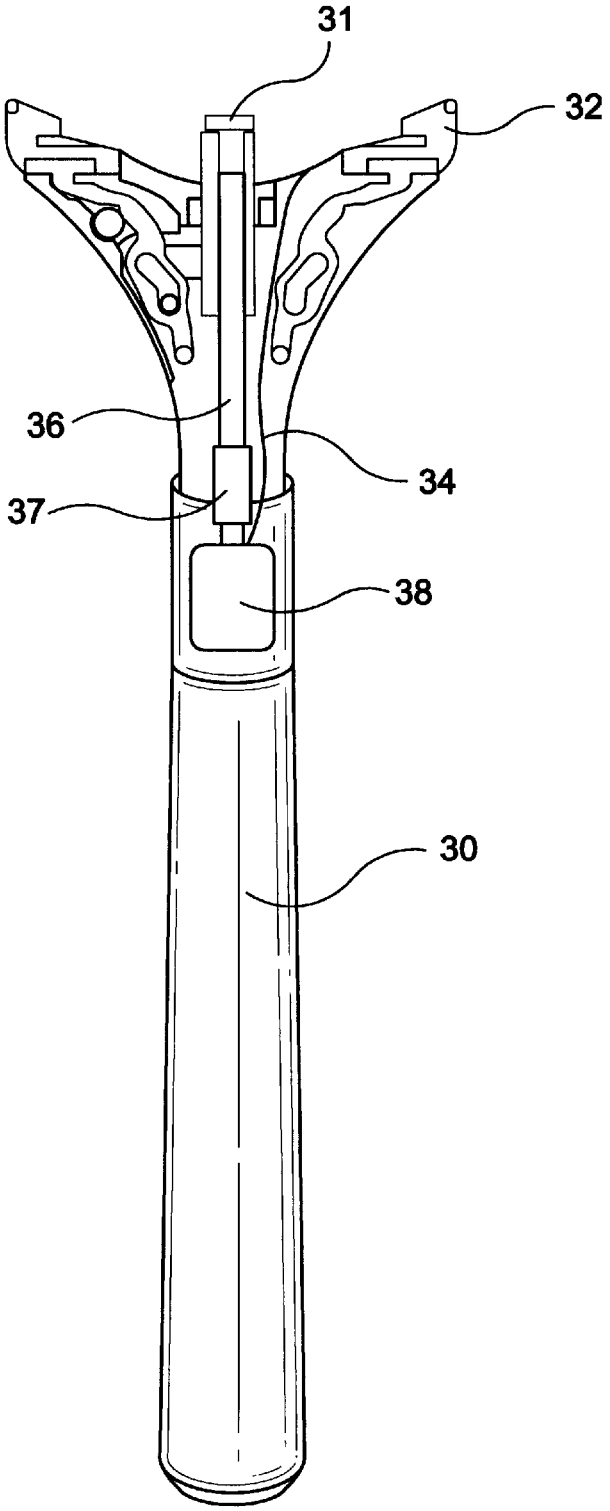
FIG. 5B is top view of a razor handle and a cut-away view of a razor cartridge having an actuator adapted to receive signals from an in situ sensor in a razor cartridge.

FIG. 5B illustrates the razor handle 30 of the present invention. The handle, in this case illustrated as a permanent system with a replaceable cartridge, comprises attachment means 32 for the attachment of the razor cartridge, piston 31, conductor 34 and a receptor which is illustrated in FIG. 5B in the form of electric motor 38. Upon the placement of a razor head on the handle, either permanently or replaceably, conductor 34 is connected to the transmitting means of the razor head to form a circuit and receive the in situ sensor signal through the transmitting means. For disposable razors, the transmitting means of the razor head and the conductor may be a single unit. For permanent systems, the connection is accomplished by placing connectors on the exposed ends of the transmitting means and the conductor so that they attach to each other upon the placement of a razor head on the handle. As with the transmitting means of the razor head, the conductor may be constructed from any suitable conductive material, such as copper wire.

Figure 6A:
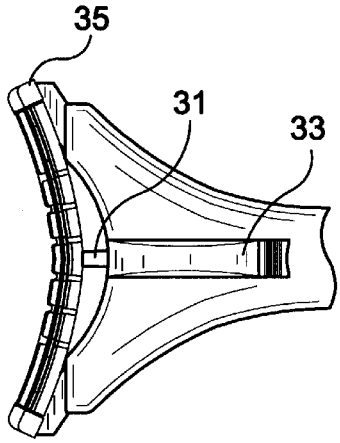
FIG. 6*a* is a top view of a razor handle and cartridge having an actuator in a retracted position.
Figure 6B:
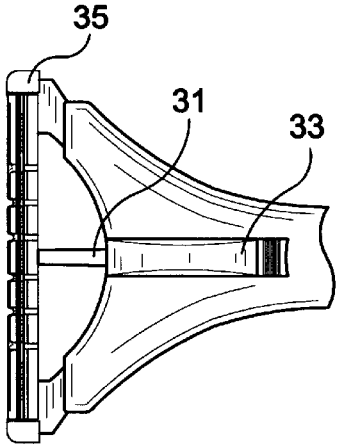
FIG. 6*b* is a top view of a razor handle and cartridge having an actuator in an unbiased position.
Figure 6C:
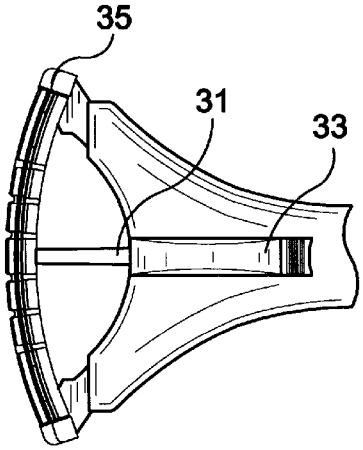
FIG. 6*c* is a top view of a razor handle and cartridge having an actuator in an extended position.

Two different preferred embodiments of receptors exist for receiving and processing the in situ sensor signal and one or more receptors may be employed in each preferred embodiment. The first receptor embodiment is an active system in which the receptor is in the form of a simple signal processing circuit which processes the in situ sensor signal and produces a response to move and position the blades. In the preferred embodiment, the receptor is a signal processing circuit in conjunction with an actuator which is used to move and position the piston 31. While the actuator may be any means for sufficiently moving the piston, as illustrated the actuator is preferably lead screw 36 which is driven by electric motor 38 in series with coupling device 37. The piston 31 or a portion of the piston is threaded and rides along the lead screw as the motor responds to the feedback signal generated by the signal processing circuit in response to the in situ sensor. Conductor 34 transmits the electrical signal from the in situ sensor to the signal processing circuit to complete the electrical circuit. Based on the motor's response to the in situ sensor signal, lead screw 36 rotates and piston 31 correspondingly extends and retracts as necessary to flex the razor head to position the razor head to produce a consistent shave. As illustrated in FIGS. 6*a*, 6*b* and 6*c*, the expansion of the piston 31 will flex the razor head 35 into a convex shape while the retraction of the piston will flex the razor head into a concave shape.

Figure 7:
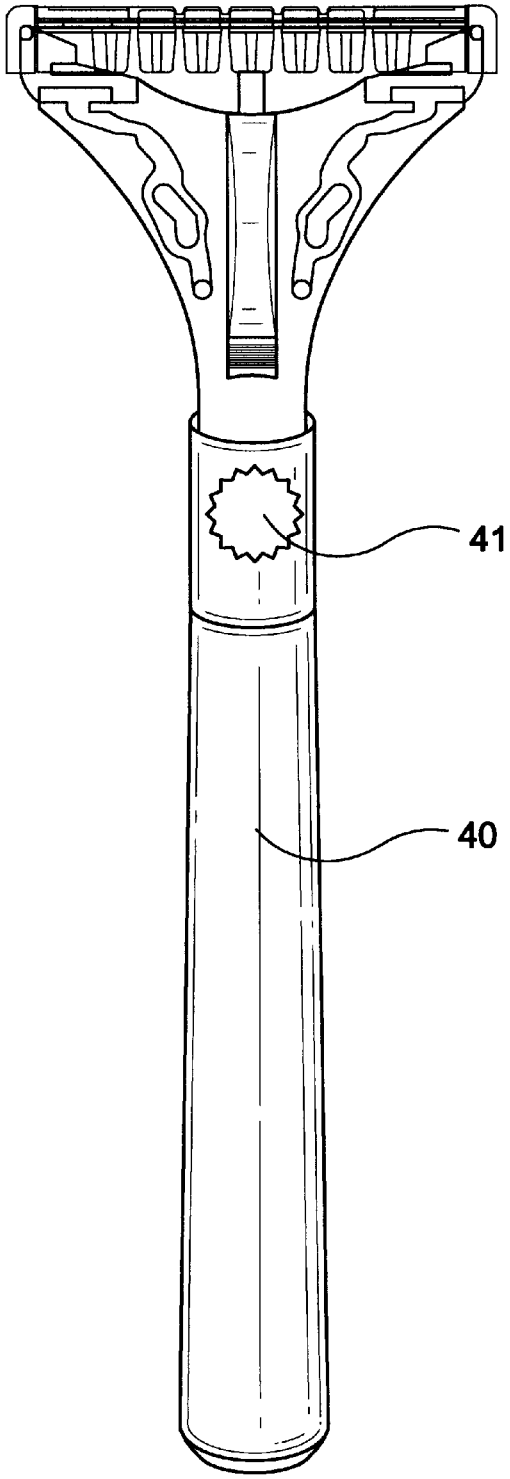
FIG. 7 is a top view of a razor handle and cartridge having an indicator light.

The second preferred receptor embodiment, illustrated in FIG. 7, is a passive system. In this embodiment one or more sensors, conductors and transmitting means between the razor head and the handle may be as in the previous embodiment. In this embodiment, the receptor in handle 40 does not produce motion but instead is a signal processing circuit which activates an indicator, such as light 41. The receptor in the passive system may also activate a light emitting diode (LED) or any other desired indicator. The signal processing circuit receives the electrical signal from the in situ sensors and activates an indicator, such as a light, which provides the user with a visual signal that he or she should take some action. For example, the in situ sensor may be used to differentiate that the user is exerting too much or too little pressure during shaving by generating a comparable electrical signal that would produce a visual indication to the user to change the shaving pressure. In addition, because blades dull over time and thus require more pressure to cut hair, the evolution of additional shaving pressure may be used to indicate that either the disposable razor should be discarded or, in a permanent system, that the razor head should be replaced. In an alternative embodiment, the voltage may be used to activate a device such as a motor or piezoelectric transducer to produce a motion, such as a vibration, or to activate an electric circuit on a circuit board or solid state chip which produces an audible sound, such as notes of a song and/or a human-like voice. In a further alternative embodiment, the passive system may be combined with the active system. For example, the receptor may activate an actuator to produce a constant shave pressure while at the same time lighting an indicator to indicate that the blades are worn and need replacing.

Figure 8:
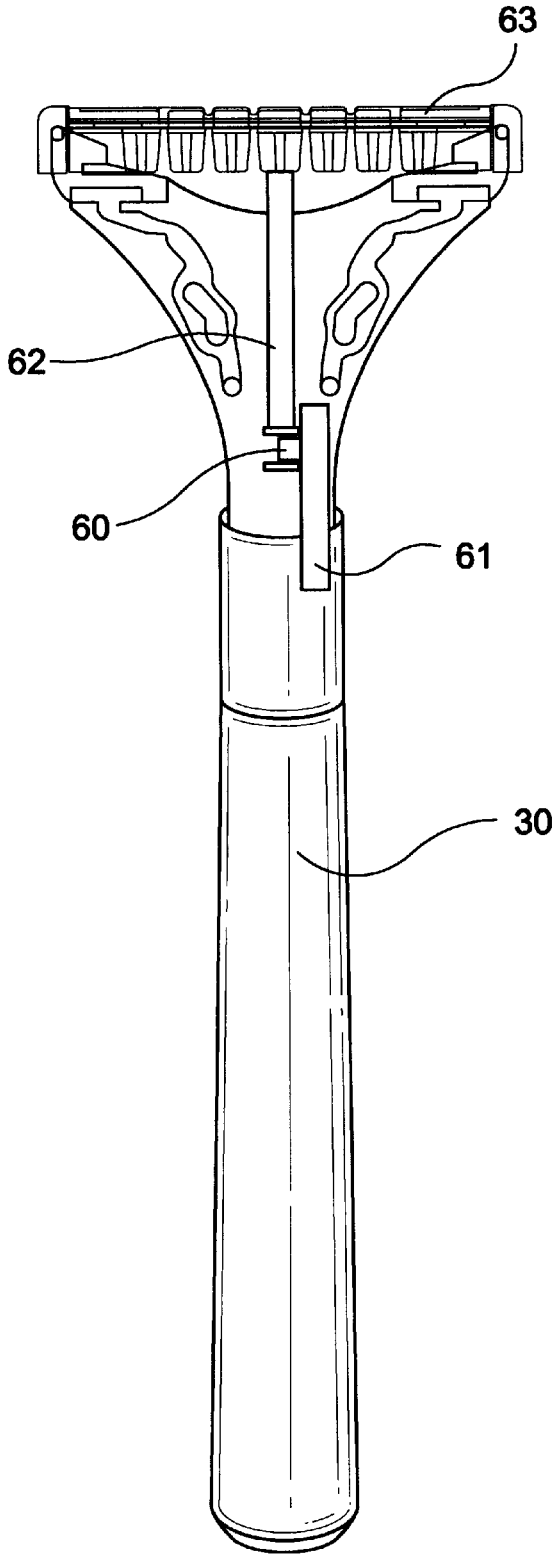
FIG. 8 is a top view of a razor handle and a cut-away view of a razor cartridge having a sliding potentiometer.
Figure 9:
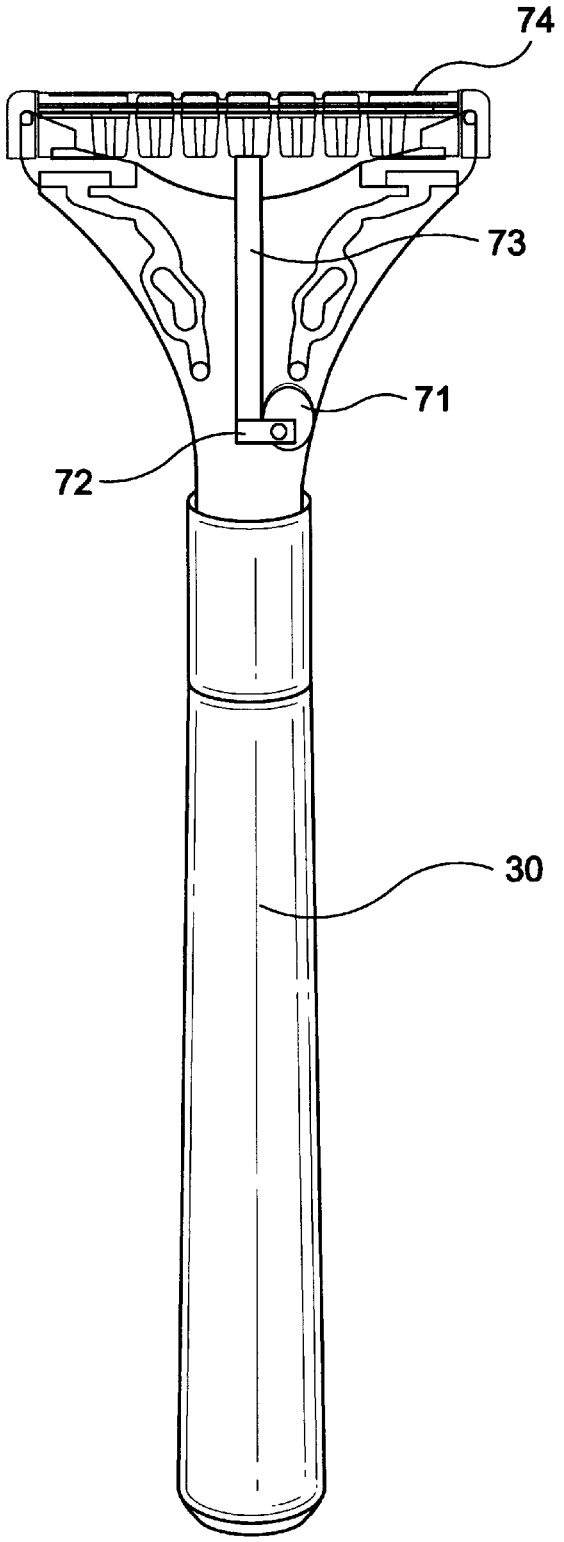
FIG. 9 is a top view of a razor handle and a cut-away view of a razor cartridge having a potentiometer.

Further alternative embodiments of an in situ sensor comprising a potentiometer are illustrated in FIGS. 8 and 9. The potentiometer detects changes in the forces applied to the blades upon transfer to the potentiometer shaft. Movement of the potentiometer shaft via a translation, as in a sliding potentiometer, or rotation, as in a potentiometer, results in a change in resistance indicative of the forces applied to the blades. Changes in resistance may be converted into an equivalent voltage change and utilized to activate a device. In the embodiment of FIG. 8, sliding potentiometer 60 is located in handle 30. Potentiometer shaft 61 of the sliding potentiometer receives forces from the blades through the shaving cartridge 63 via piston 62. The change in resistance resulting from the movement of the potentiometer shaft along the sliding potentiometer may be converted into an equivalent voltage change and utilized to activate an actuator or indicator or some other device which will movably respond or produce a visual indication to the user. In the embodiment of FIG. 9, a potentiometer 71 is located in handle 30. Forces encountered during shaving are translated from cartridge 74 via piston 73 to lever 72 and then onto potentiometer shaft 71. As with the previous embodiment, the translation of the forces will cause the potentiometer to produce a resistance change which may be converted to an equivalent voltage and utilized to activate an actuator or visual indicator in response to the applied shaving forces. In an alternative embodiment, a combination of receptors may be employed such that either multiple active responses are produced, multiple passive responses are produced, or a combination of active and passive responses are produced.

While there have been described what are presently believed to be the preferred embodiments of the present invention, those skilled in the art will realize that various changes and modifications may be made to the invention without departing from the spirit of the invention, and it is intended to claim all such changes and modifications as fall within the scope of the invention.

I claim:

1. A wet shave razor system comprising a razor head having one or more blades and a handle, wherein the razor head further comprises one or more in situ sensors comprising piezoelectric or piezoresistive material in a non-directly skin-engaging position for producing a feedback signal based on forces encountered during shaving, the handle further comprises one or more receptors for receiving the signal from the one or more in situ sensors, wherein conducting means extend from the one or more in situ sensors to the receptor to provide an electrical circuit between the one or more in situ sensors and the one or more receptors, wherein the one or more receptors comprise a feedback signal processing circuit which receives the feedback signal and the feedback signal processing circuit is connected to an indicator which comprises a light, a light emitting diode, a motion producing device, or any combination thereof which produces an indication in response to the feedback signal.

2. A razor system according to claim 1, wherein the one or more in situ sensors are in the form of a polymer which is applied to one or more of the one or more blades.

3. A razor system according to claim 2, wherein the in situ sensors consist of polyvinylidene fluoride.

4. A razor system according to claim 1, wherein the feedback signal processing circuit is connected to an actuator and wherein the feedback signal processing circuit produces a response to the feedback signal which drives the actuator to move the razor head or the one or more blades to provide consistent pressure on a surface being shaved.

5. A razor system according to claim 1, wherein the indicator provides a signal to a user that the one or more blades are worn and need replacement.

6. A razor system according to claim 1, wherein the indicator provides a signal to a user that the user should apply a different pressure to the razor during shaving.

7. A razor system according to claim 1, wherein the razor head is permanently attached to the handle.

8. A razor system according to claim 1, wherein the razor head is removably attached to the handle.

9. A razor system according to claim 1, wherein the one or more in situ sensors are in the form of a spacer located between one or more of the one or more blades.

10. A wet shave razor head having one or more blades and one or more in situ sensors comprising piezoelectric or piezoresistive material located in non-directly skin-engaging locations for producing a signal based on forces encountered during shaving.

11. A razor head according to claim 10, wherein the one or more in situ sensors are in the form of a polymer which is applied to one or more of the one or more blades.

12. A razor head according to claim 11, wherein the in situ sensors consist of polyvinylidene fluoride.

13. A razor head according to claim 10, wherein the one or more in situ sensors are in the form of a spacer located between one or more of the one or more blades.

14. A razor handle having one or more receptors for receiving in situ sensor signals from one or more in situ sensors located in non-directly skin-engaging locations responding to forces encountered during shaving, wherein the one or more receptors comprise a signal processing circuit which produces a feedback signal in response to the in situ sensor signal, wherein the receptor comprises a feedback signal processing circuit and an indicator which comprises a light, a light emitting diode, a motion producing device, or any combination thereof which produces a feedback signal in response to the in situ sensor feedback signal.

15. A razor handle according to claim 14, wherein the indicator provides a signal to a user that the one or more blades are worn and need replacement.

16. A razor handle according to claim 14, wherein the indicator provides a signal to a user that the user should apply a different pressure to the razor during shaving.

17. A razor handle comprising one or more in situ sensors for producing a signal based on forces encountered during shaving wherein the one or more in situ sensors further comprise a potentiometer or a sliding potentiometer.

18. A razor handle according to claim 17, wherein the one or more in situ sensors comprise a piezoresistive or a piezoelectric material.

19. A razor handle according to claim 18, further comprising a piston wherein movement of the piston in response to forces encountered during shaving is translated to the piezoresistive or piezoelectric material.

20. A razor handle according to claim 17, further comprising a piston wherein movement of the piston in response to forces encountered during shaving is translated to the potentiometer.

21. A razor handle having one or more receptors for receiving in situ sensor signals from one or more in situ sensors located in non-directly skin-engaging locations responding to the forces encountered during shaving, wherein the one or more receptors comprise a feedback signal processing circuit which produces a feedback signal in response to the in situ sensor signal and wherein the feedback signal processing circuit is connected to an actuator and the feedback signal processing circuit produces a response to the in situ sensor signal.

* * * * *